US010820977B2

(12) United States Patent
Talati et al.

(10) Patent No.: US 10,820,977 B2
(45) Date of Patent: Nov. 3, 2020

(54) METHOD AND APPARATUS FOR ADMINISTERING SUPPLEMENTAL OXYGEN THERAPY AT AMBIENT CONDITIONS USING A VETERINARY HYPERBARIC CHAMBER

(71) Applicant: Sechrist Industries, Inc., Anaheim, CA (US)

(72) Inventors: Deepak Ambalal Talati, Yorba Linda, CA (US); Danny Bruce Hudson, Perris, CA (US); Teofilo Raymund G. Tan, III, Anaheim, CA (US); Ronald Lyman, Fort Pierce, FL (US)

(73) Assignee: Sechrist Industries, Inc., Anaheim, CA (US)

( * ) Notice: Subject to any disclaimer, the term of this patent is extended or adjusted under 35 U.S.C. 154(b) by 470 days.

(21) Appl. No.: 15/660,817

(22) Filed: Jul. 26, 2017

(65) Prior Publication Data

US 2018/0028299 A1 Feb. 1, 2018

Related U.S. Application Data

(60) Provisional application No. 62/369,656, filed on Aug. 1, 2016, provisional application No. 62/399,681, filed on Sep. 26, 2016.

(51) Int. Cl.
*A61D 7/00* (2006.01)
*A61G 10/02* (2006.01)
(Continued)

(52) U.S. Cl.
CPC ..... *A61D 7/00* (2013.01); *A61D 7/04* (2013.01); *A61G 10/026* (2013.01); *A62B 31/00* (2013.01)

(58) Field of Classification Search
CPC ..... A61D 7/00; A61D 7/04; A61G 10/026; A61G 10/023; A61G 10/04; A62B 31/00;
(Continued)

(56) References Cited

U.S. PATENT DOCUMENTS 3,727,627 A * 4/1973 Bird ..... A61M 16/20 137/100
3,789,837 A * 2/1974 Philips ..... A61M 16/205 128/202.22

(Continued)

OTHER PUBLICATIONS www.hvmed.com; "The hvm Advantage—Originators of the Small-Animal Veterinary Hyperbaric Chamber"; Oct. 9, 2017; 1 page.

(Continued)

*Primary Examiner* — Timothy A Stanis
*Assistant Examiner* — Thao Tran
(74) *Attorney, Agent, or Firm* — Stetina Brunda Garred and Brucker

(57) ABSTRACT

A system and method of administrating conventional hyperbaric chamber therapy as well as supplemental oxygen therapy at ambient conditions to an animal using a veterinary hyperbaric chamber. The hyperbaric chamber can function in its usual mode of operation; i.e., providing oxygen at greater than atmospheric pressure and also in a second mode of operation to administer supplemental oxygen thereafter at ambient pressure conditions. In the second mode of operation, the method and apparatus may deliver approximately 80 liters per minute continuous flow of 0.21 through 1.0 FI02 adjustable oxygen gas mixture. The mixture is delivered at ambient pressure from one end of the chamber, flows across the animal positioned within the hyperbaric chamber, and exits at the opposite end for exhaust to ambient conditions. A high flow gas mixture is utilized to maintain accurate gas mixture concentrations with fluctuating supply pressures of medical air and medical oxygen gases.

20 Claims, 4 Drawing Sheets

(51) Int. Cl.
*A62B 31/00* (2006.01)
*A61D 7/04* (2006.01)

(58) Field of Classification Search
CPC ..... A61M 16/201; A61M 16/202; A61M 16/206; A61M 39/223; A61M 2039/2446; A61M 2039/246
See application file for complete search history.

(56) References Cited

U.S. PATENT DOCUMENTS 4,313,436 A * 2/1982 Schwanbom ..... A61M 16/104 128/200.19
6,024,087 A * 2/2000 Kersey ..... A61M 16/204 128/203.12
8,025,055 B1 * 9/2011 Grady ..... A61M 16/00 128/205.26
8,375,938 B2 * 2/2013 Gaumond ..... A61G 10/026 128/202.12
2004/0168686 A1 * 9/2004 Krebs ..... A61M 16/1015 128/203.12
2008/0295842 A1 * 12/2008 Hete ..... A61M 16/12 128/205.24
2009/0038618 A1 * 2/2009 Grauke ..... A61G 10/026 128/205.26
2011/0048424 A1 * 3/2011 Radko ..... A61G 10/026 128/205.26
2016/0001023 A1 * 1/2016 Li ..... A61M 16/12 128/203.14
2018/0177961 A1 * 6/2018 Kagan ..... A61M 16/12

OTHER PUBLICATIONS www/plas-labs.com; "Lab C02/Vacuum Chambers"; Oct. 9, 2017; 3 pages.
www.snydermfg.com; "Intensive Care Units (ICU)"; Oct. 9, 2017; 4 pages.

* cited by examiner

METHOD AND APPARATUS FOR ADMINISTERING SUPPLEMENTAL OXYGEN THERAPY AT AMBIENT CONDITIONS USING A VETERINARY HYPERBARIC CHAMBER

CROSS-REFERENCE TO RELATED APPLICATIONS

This application claims the benefit of U.S. Provisional Application Ser. No. 62/369,656, filed Aug. 1, 2016, and U.S. Provisional Application Ser. No. 62/399,681, filed Sep. 26, 2016, the contents of both of which are expressly incorporated herein by reference.

STATEMENT RE: FEDERALLY SPONSORED RESEARCH/DEVELOPMENT

Not Applicable

BACKGROUND

1. Technical Field

The present disclosure relates generally to veterinary treatment, and more specifically to a dual-purpose veterinary device capable of performing hyperbaric veterinary therapy, as well as supplemental oxygen therapy.

2. Description of the Related Art

Hyperbaric medical therapy is well known and has been used to treat human medical conditions for decades. In general, hyperbaric therapies refer to medical treatments in which the pressure applied to the patient is greater than sea level atmospheric pressure. Hyperbaric therapy typically entails placing a patient inside a pressure chamber and delivering oxygen under pressure into the chamber. Exemplary human medical conditions for which hyperbaric therapies may be used for treatment include air or gas embolism, carbon monoxide poisoning, thermal burns, compromised skin grafts and flaps, central retinal arty occlusion, and decompression sickness.

Given the success of hyperbaric oxygen therapy in humans, there has been a recent trend to use hyperbaric oxygen therapy to treat pets and animals. For instance, hyperbaric oxygen therapies have been used to treat burns, snake bites, and diskospondylitis, among other ailments, in pets. Such veterinary hyperbaric therapies are typically performed in a dedicated hyperbaric chamber, which is designed for the sole purpose of performing hyperbaric treatments.

In addition to hyperbaric oxygen therapy, oftentimes in veterinarian applications, it is necessary to delivery an adjustable amount of an enriched oxygen gas mixture to the animal. However, the delivery of such enriched oxygen gas to animals is typically very troublesome and requires the use of masks, hoods, cannulas, or cages for proper administration.

As such, there is a need in the art for an improved method and apparatus for performing hyperbaric oxygen therapy, as well as delivering adjustable quantities of enriched oxygen gas mixture to an animal without the need for use of troublesome masks, hoods, cannulas, and the like. Various aspects of the present disclosure address this particular need, as will be discussed in more detail below.

BRIEF SUMMARY

The present disclosure comprises a unique system and method of administrating conventional hyperbaric chamber therapy as well as supplemental oxygen therapy at ambient conditions to an animal using a veterinary hyperbaric chamber. The hyperbaric chamber can function in its usual mode of operation; i.e., providing oxygen at greater than atmospheric pressure and also in a second mode of operation to administer supplemental oxygen thereafter at ambient pressure conditions. In the second mode of operation, the method and apparatus may deliver approximately 80 liters per minute continuous flow of 0.21 through 1.0 FI02 adjustable oxygen gas mixture. The mixture is delivered at ambient pressure from one end of the chamber, flows across the animal positioned within the hyperbaric chamber, and exits at the opposite end for exhaust to ambient conditions. A high flow gas mixer is utilized to maintain accurate gas mixture concentrations with fluctuating supply pressures of medical air and medical oxygen gases.

The system and method may also allow for operation in an emergency mode, wherein fluid in the chamber is vented therefrom. The emergency mode may be actuated by a through a single actuation mechanism, e.g., a shutdown switch, or by simultaneous actuation of multiple actuation mechanisms. The emergency mode may be actuated only when the system and method is operating in a hyperbaric operational mode.

The system may also incorporate an alarm/bypass module which monitors gas supply pressures, sounds an alarm, and bypasses the remaining gas supply in the event of a supply gas failure. The alarm/bypass module may be operational only in a free flow mode.

According to one embodiment, there is provided a multi-mode, veterinary therapy chamber device comprising a housing including a therapy chamber, an oxygen inlet connectable to a source of pressurized oxygen, and an air inlet connectable to a source of pressurized air. A fluid delivery network is connected to the oxygen inlet, the air inlet and the therapy chamber. The fluid delivery network is selectively transitional between at least two different operational modes including a first operational mode wherein the fluid delivery network establishes fluid communication between the oxygen inlet and the therapy chamber, and isolates the air inlet from the therapy chamber to facilitate delivery of pressurized oxygen into the therapy chamber, and a second operational mode wherein the fluid delivery network establishes fluid communication between the oxygen inlet and the therapy chamber and the air inlet and the therapy chamber to facilitate delivery of a mixture of oxygen and air to the therapy chamber.

The fluid delivery network may include a mixer fluidly connectable to the oxygen inlet and the air inlet when the fluid delivery network is in the second operational mode. The mixer may be operative to facilitate varying a ratio of oxygen-to-air in the mixture delivered to the therapy chamber. The mixer may include a mixer air inlet, a mixer oxygen inlet, and a pressure balancing chamber in communication with the mixer air inlet and the mixer oxygen inlet. A diaphragm may extend through the pressure balancing chamber, and an air valve body may be coupled to the diaphragm, with the air valve body being sized and positioned to control fluid flow from the mixer air inlet to the pressure balancing chamber. An oxygen valve body may be coupled to the diaphragm, with the oxygen valve body being sized and positioned to control fluid flow from the mixer oxygen inlet to the pressure balancing chamber. The mixer may further include a mixing chamber in communication with the pressure balancing chamber. A valve body may be moveable relative to the mixing chamber, with the valve body being sized and structured to vary the ratio of oxygen-to-air in the mixture exiting the mixing chamber for delivery to the therapy chamber. The mixer may additionally include a mixer housing and the valve body may include at least one tapered surface which interfaces with the mixer housing for varying the ratio of oxygen-to-air in the mixture exiting the mixing chamber for delivery to the therapy chamber.

The mixer may also include an alarm in fluid communication with the mixer air inlet and the mixer oxygen inlet, with the alarm generating an alarm signal in response to fluid pressure at one of the mixer air inlet and the mixer oxygen inlet falling below a prescribed threshold.

The fluid delivery network may include a first oxygen valve in fluid communication with the oxygen inlet, a second oxygen valve in fluid communication with the oxygen inlet and the mixer, and an air valve in fluid communication with the air inlet and the mixer. In the first operational mode, the first oxygen valve may be open to allow pressurized oxygen to flow therethrough, and the second oxygen valve and air valve both being closed to prevent fluid flow therethrough. In the second operational mode, the first oxygen valve may be closed to prevent fluid flow therethrough, and the second oxygen valve and air valve may both be open to allow pressurized oxygen and pressurized air to flow through the second oxygen valve and the air valve, respectively. The first oxygen valve, second oxygen valve, and air valve may be normally closed, and are capable of being transitioned to respective open positions in response to a pressurized control fluid being applied thereto.

The device may additionally comprise a fluid control network in fluid communication with the fluid delivery network and at least one of the oxygen inlet and the air inlet. The fluid control network may be operative to receive pressurized fluid from the at least one of the oxygen inlet and the air inlet and implement transition between the at least two different operational modes of the fluid delivery network. The device may further comprise a master control valve in operative communication with the fluid control network. The master control valve may be transitional between a first position and a second position, the first position being associated with the first operational mode and the second position being associated with the second operational mode.

The fluid delivery network may include an alarm operative to generate an alarm signal in response to a fluid pressure within the fluid delivery network falling below a prescribed threshold. The alarm may be operational only in a free flow mode.

The device may include a relief valve in communication with the fluid delivery network, the relief valve being operative to exhaust fluid from the fluid delivery network in response to a fluid pressure in the fluid delivery network exceeding a prescribed threshold. The prescribed threshold may be 35 PSI.

The device may include a vent valve downstream of the therapy chamber, the vent valve being normally closed and operative to open to vent fluid from the therapy chamber.

According to yet another embodiment, there is provided a fluid system for multi-mode veterinary chamber therapy. The fluid system comprises an oxygen inlet and an air inlet. A first mode fluid network is fluidly connectable to the oxygen inlet and a veterinary therapy chamber, with the first mode fluid network being operative to communicate oxygen from the oxygen inlet to the veterinary therapy chamber. A second mode fluid network is fluidly connectable with the oxygen inlet, the air inlet, and the veterinary therapy chamber. The second mode network is operative to receive oxygen from the oxygen inlet and air from the air inlet and deliver a mixture of oxygen and air to the veterinary therapy chamber. A controller is in operative communication with the first mode fluid network and the second mode fluid network, with the controller being operative to control delivery of fluid to the veterinary therapy chamber via the first mode fluid network and the second mode fluid network.

According to a further embodiment, there is provided a fluid control method for multi-mode veterinary chamber therapy, the method includes the step of opening a first mode passageway within a fluid delivery network to operate the fluid delivery network in a first operational mode wherein the fluid delivery network delivers pressurized oxygen from a pressurized oxygen source to a therapy chamber. The method further includes opening a second mode passageway within the fluid delivery network to operate the fluid delivery network in a second operational mode wherein the fluid delivery network delivers a mixture of pressurized oxygen and air to the therapy chamber.

The method may include the step of opening a vent passageway to vent fluid from the therapy chamber.

The first mode passageway may be associated with at least one first mode valve and the second mode passageway may be associated with at least one second mode valve, and the method may further include the steps of applying fluid pressure to the at least one first mode valve to open the first mode passageway, and applying fluid pressure to the at least one second mode valve to open the second mode passageway.

The method may additionally include mixing oxygen and air flowing through the second mode passageway prior to delivery to the therapy chamber.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of certain embodiments of a dual-mode veterinary hyperbaric chamber and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

The present disclosure comprises an improved hyperbaric chamber which is specifically adapted for veterinarian use. Those skilled in the art recognize that conventional hyperbaric chambers are currently being utilized for the treatment of many medical conditions. Such hyperbaric chambers are utilized to provide hyperbaric oxygen therapy, which is the clinical treatment where a patient/animal breathes while enclosed in a hyperbaric oxygen chamber at pressure values generally 2-3 times greater than atmospheric pressure. The patients/animals are placed in the hyperbaric chamber and typically breathe 100% oxygen while exposed to elevated ambient pressures. As an application of an established technology, hyperbaric oxygen therapy is helping to resolve a growing number of difficult, and expensive to treat medical conditions.

The present disclosure extends the use of hyperbaric chambers to the veterinarian field and with modification of a conventional hyperbaric chamber to provide a first conventional hyperbaric mode of operation to deliver oxygen to a patient/animal at pressures above ambient pressure and as second mode of operation comprising a method of administering variable supplemental oxygen therapy at ambient pressure conditions to a patient/animal. As such, the hyperbaric chamber described herein may be used to more easily deliver an adjustable amount of an enriched oxygen gas mixture to the animal, without the use of masks, hoods, cannulas, or cages.

Figure 1:
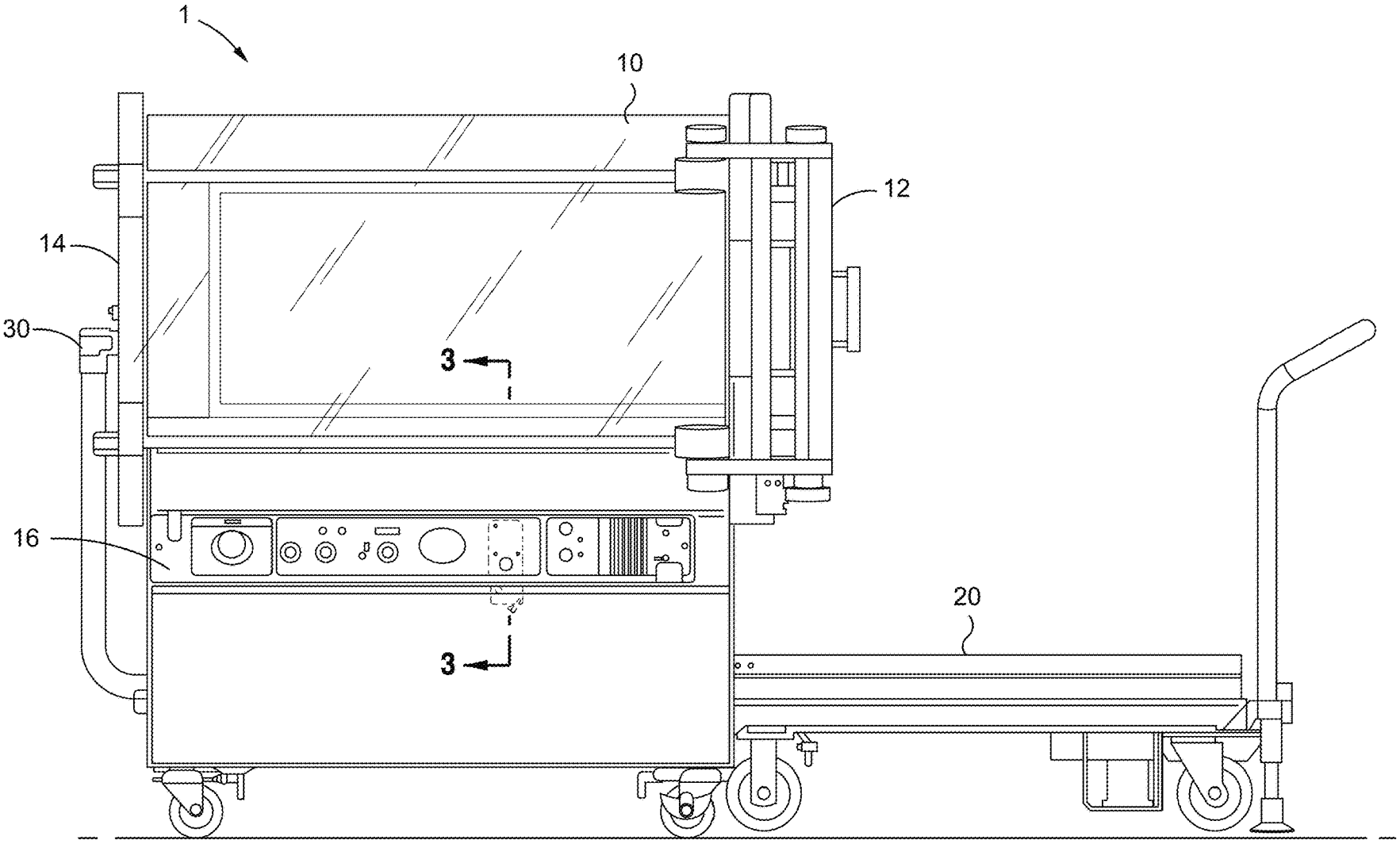
FIG. 1 is a side elevational view of a dual-mode veterinary hyperbaric chamber of the present disclosure.

Referring to FIG. 1, an improved hyperbaric chamber 1 adapted for veterinary use is depicted. The hyperbaric chamber 1 includes a chamber housing 10, which includes a front door 12, a rear end panel 14, and a control system 16 to control either conventional hyperbaric chamber operation or a unique method of administrating supplemental oxygen therapy at ambient conditions through the interior of the chamber housing 10. A patient/animal gurney 20 is preferably provided which can be stored within the lower section of the hyperbaric chamber 1 and be utilized to lift the patient/animal to a proper elevation for entry through the door 12 into the interior of the chamber housing 10.

Figure 2:
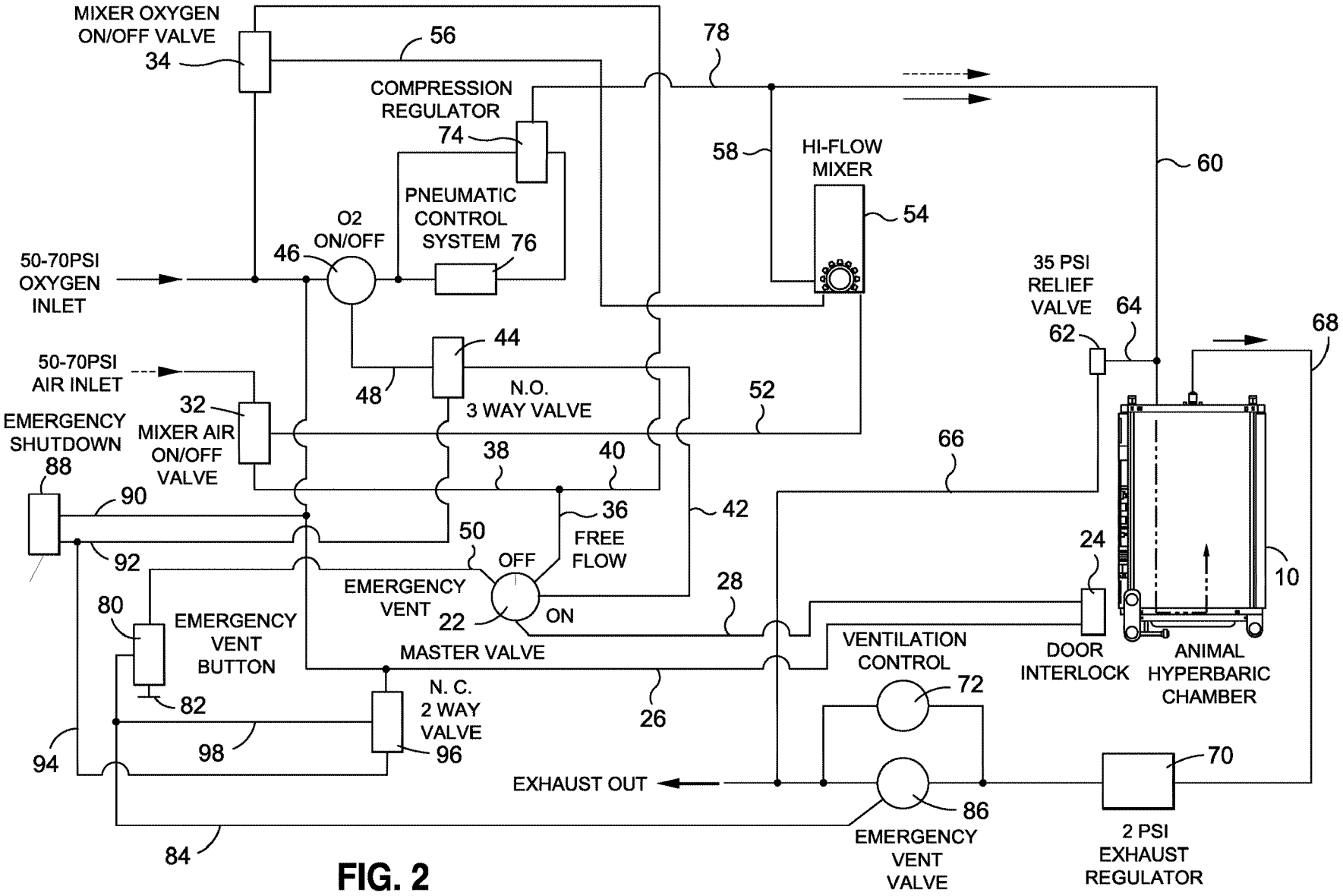
FIG. 2 is a fluid circuit schematic diagram for the dual-mode veterinary hyperbaric chamber of the present disclosure.

A schematic of the control system for selectively administering hyperbaric treatment or supplemental oxygen therapy at ambient conditions within the chamber 1 is shown in FIG. 2. As shown, the system includes an oxygen inlet as well as a separate air inlet, both of which are preferably provided under a pressure of 50-70 pounds per square inch. The control system includes several control valves between the oxygen inlet and air inlet, as well as a master control valve 22 to selectively switch between the various operational modes, including FREE FLOW mode (i.e., oxygen therapy mode), HYPERBARIC mode, or EMERGENCY mode.

The control system includes a built-in failsafe, which ensures that the door 12 to the chamber housing 10 is closed before pressurized fluid is delivered into the chamber housing 10. In this regard, the system blocks the air inlet and oxygen inlet from the chamber housing 10 when the door 12 is open. This built-in failsafe utilizes door interlock 24, which is fluidly connected to the oxygen inlet via conduit 26, as well as being operatively coupled to door 12. The door interlock 24 is configured such that when the door 12 is closed, the conduit 26 is placed in fluid communication with conduit 28, via the door interlock 24. Conversely, when the door 12 is open, conduit 28 is fluidly isolated from conduit 26. In this regard, conduit 28 only receives pressurized fluid from the oxygen inlet when the door 12 is closed.

Conduit 28 is connected to the door interlock 24 on one end, and the master valve 22 on the other end, with conduit 28 functioning as a pneumatic control supply conduit, which provides pressurized fluid, e.g., oxygen, to the master valve 22 for purposes of providing pneumatic control throughout the system. In this regard, the control system includes several pressure actuated valves which are controlled by opening and closing various pneumatic control conduits emanating from the master valve 22. A free flow control conduit extends between the master valve 28 and a mixer air on/off valve 32 as well as a mixer oxygen on/off valve 34. The free flow control conduit includes a first segment 36, which then branches into a second segment 38 and a third segment 40. The first segment 36 extends from the master valve 22, while the second segment 38 leads to the mixer air on/off valve 32 and the third segment 40 leads to the mixer oxygen on/off valve 34. A hyperbaric control conduit 42 extends between the master valve 22 and a 3-way valve 44, which in turn is connected to an oxygen on/off valve 46 via interconnecting conduit 48. An emergency control conduit 50 extends from the master valve 22 and is used during an EMERGENCY mode, as will be described in more detail below.

The master valve 22 is selectively positionable in four different positions, namely an OFF position, a FREE FLOW position, an ON position (i.e., hyperbaric operation position), and an EMERGENCY VENT position, with each position being associated with a different operational mode. When the master valve 22 is in the OFF position, the system is considered to be in an OFF mode, with the pressurized control fluid being blocked from pneumatic control conduits 36, 42, 50 by the master valve 22. As such, no oxygen or air is delivered from their respective inlets to the chamber housing 10. When the master valve 22 is in the FREE FLOW position, the system is considered to be in a FREE FLOW mode, wherein a mixture of oxygen and air are delivered into the chamber housing 10 for ventilation therapy. When the master valve 22 is in the ON position, the system is considered to be in a HYPERBARIC mode, wherein oxygen is delivered into the chamber housing 10 for hyperbaric therapy. In the HYPERBARIC mode, the air inlet may be isolated from the chamber housing 10. When the master valve 22 is in the EMERGENCY VENT position, the system is considered to be in a VENT mode, wherein fluid within the chamber housing 10 may be vented, such as may be required in an emergency condition. Each operational mode will now be described in more detail below.

When the system is in the FREE FLOW mode, the master valve 22 routes the pressurized control fluid received from conduit 28 into the first segment 36 of the free flow control conduit. The pressurized fluid is then divided into the second and third segments 38, 40 of the free flow control conduit. The pressurized fluid in the second segment 38 applies pressure to the normally-closed mixer air on/off valve 32, which causes the mixer air on/off valve 32 to open. When the mixer air on/off valve 32 opens, it allows pressurized air from the air inlet to flow through conduit 52, which extends between the mixer air on/off valve 32 and a hi-flow mixer 54, thereby allowing pressurized air to flow into hi-flow mixer 54. Similarly, the pressurized fluid in the third segment 40 applies pressure to the normally-closed mixer oxygen on/off valve 34, which causes the mixer oxygen on/off valve 34 to open. When the mixer oxygen on/off valve 34 opens, it allows pressurized oxygen from the oxygen inlet to flow through conduit 56, which extends between the mixer oxygen on/off valve 34 and the hi-flow mixer 54, thereby allowing pressurized oxygen to flow into hi-flow mixer 54. The mixer air on/off valve 32 and mixer oxygen on/off valve 34 are both configured such that when pressure is not applied to the valves 32, 34 via the respective conduits 38, 40, the valves 32, 34 are closed to prevent air and oxygen, respectively, from flowing therethrough.

Figure 3:
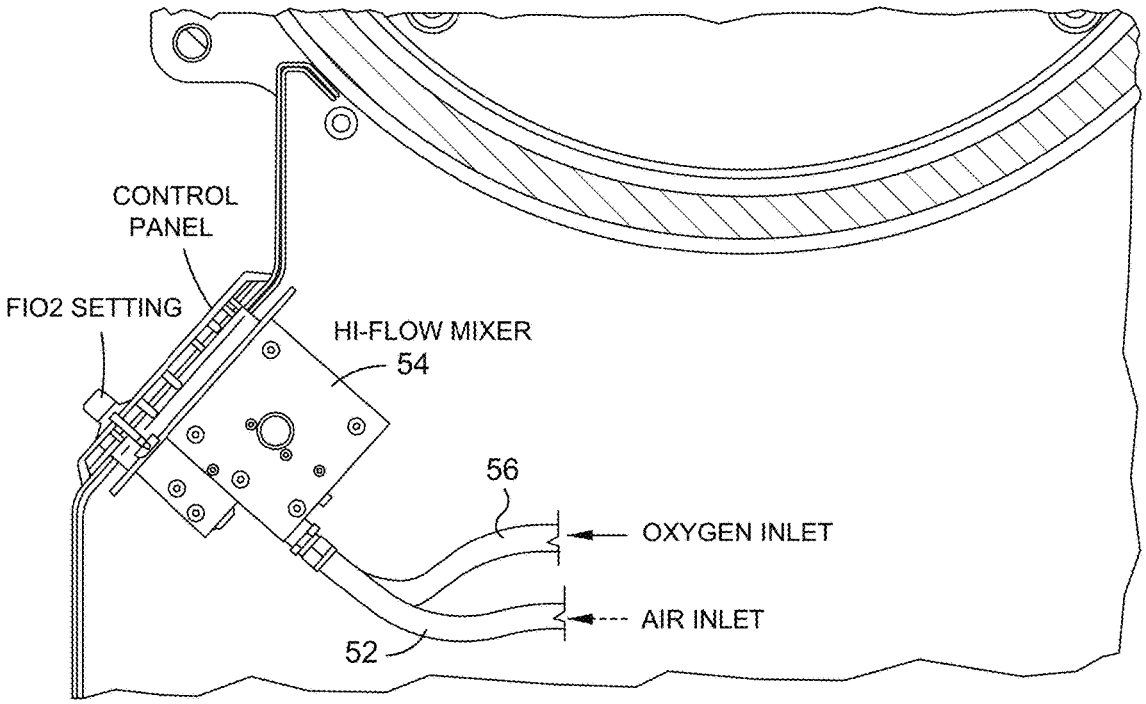
FIG. 3 is a side view of a high flow gas mixture mixer utilized with the dual-mode veterinary hyperbaric chamber.
Figure 4:
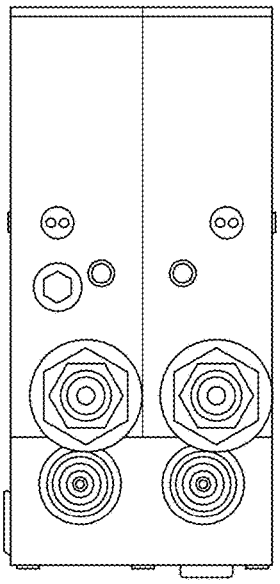
FIG. 4 is a front view of the high flow gas mixture mixer depicted in FIG. 3.
Figure 5:
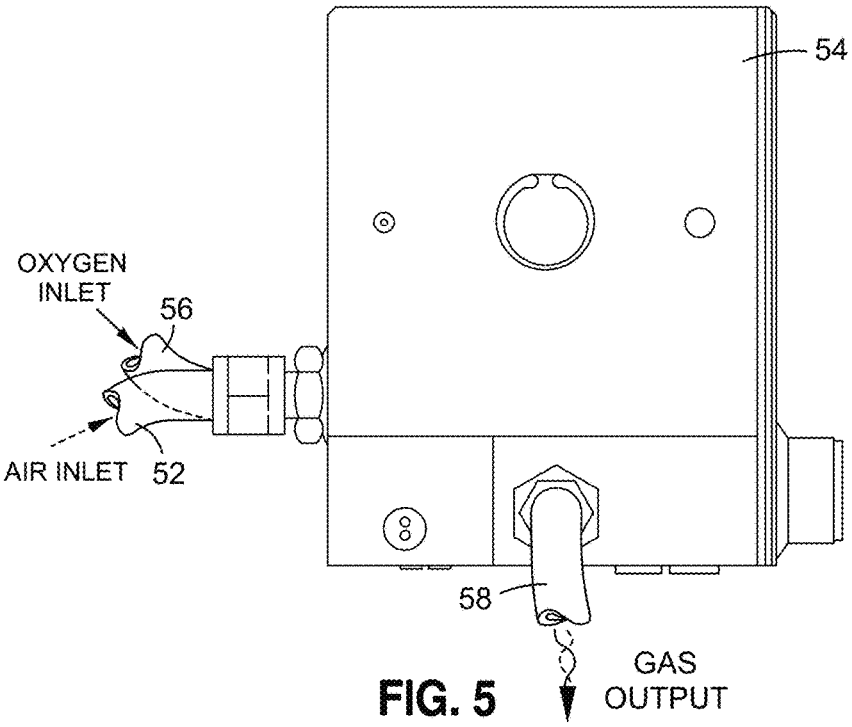
FIG. 5 is a side view of the high flow gas mixture mixer taken from an opposite perspective from that shown in FIG. 3.
Figure 6:
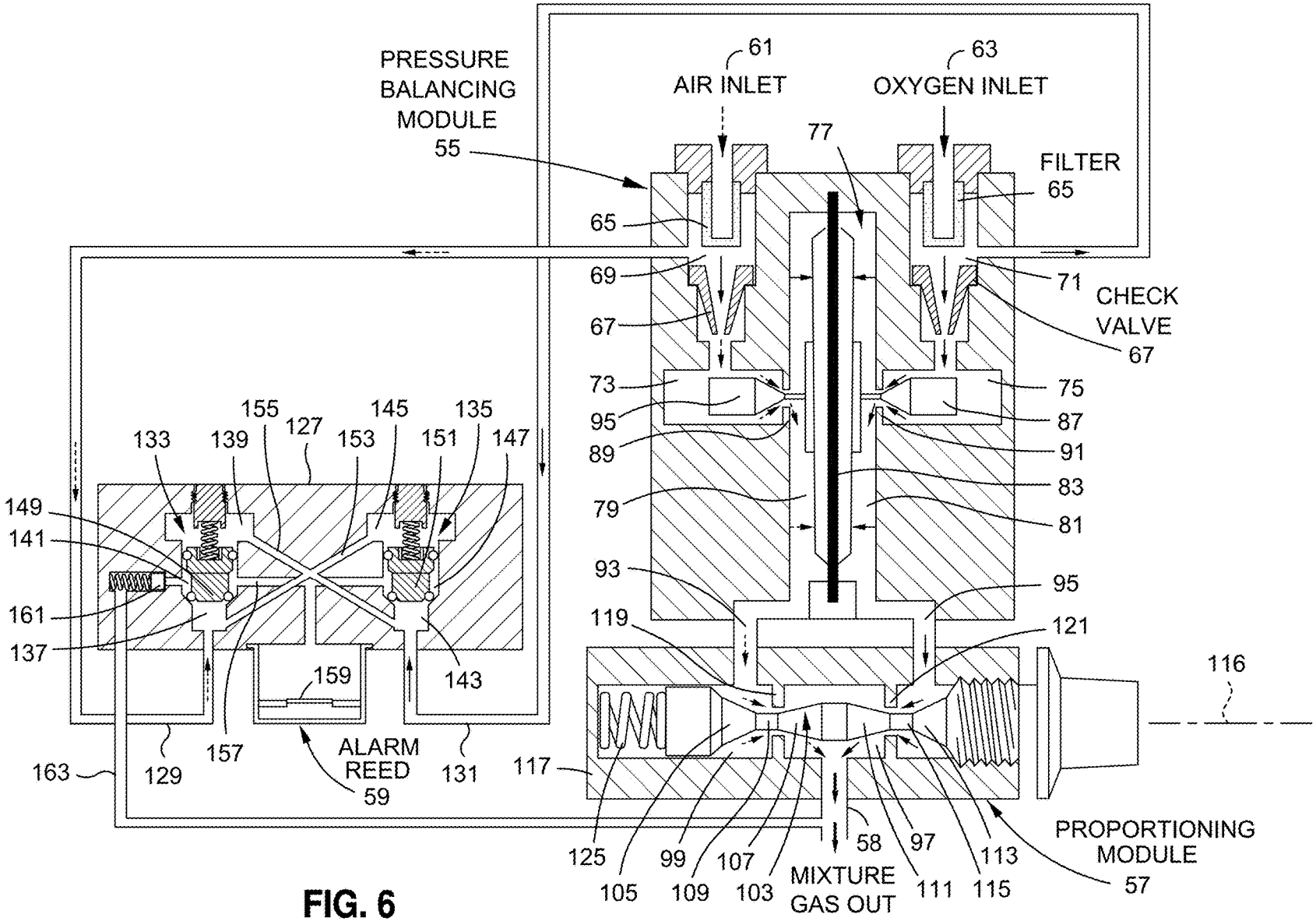
FIG. 6 is a cross sectional view of the gas mixture mixer of the present disclosure.

The hi-flow mixer 54 outputs a mixture of air and oxygen through conduit 58. According to one embodiment, the hi-flow mixer 54 allows an adjustable mixing of the air and oxygen which is supplied to conduit 56. Although the hi-flow mixer 54 is shown schematically in FIG. 2, an exemplary embodiment of the hi-flow mixer 54 is shown in FIGS. 3, 4 and 5 and a more detailed schematic of the hi-flow mixer 54 is depicted in FIG. 6. The output of the hi-flow mixer 54 is controlled via a proportioning module shown in FIG. 6.

Referring now specifically to FIG. 6, the following discussion will focus on an exemplary embodiment of the hi-flow mixer 54. In general, the hi-flow mixer 54 includes a pressure balancing module 55, a proportioning module 57, and an alarm module 59. The pressure balancing module 55 includes a housing having an air inlet 61 fluidly connectable to conduit 52, and an oxygen inlet 63 fluidly connectable to conduit 56. An air inlet passageway 69 is in communication with the air inlet 61 and an oxygen inlet passageway 71 is in communication with the oxygen inlet 63. The mixer 54 includes a pair of filters 65, with each filter 65 being located in a respective inlet passageway 69, 71 to filter debris which may be possibly flowing in the air or oxygen entering the mixer 54. The mixer 54 additionally includes a pair of check valves 67, with each check valve 67 being in fluid communication with a respective inlet 61, 63 and downstream of the corresponding filter 65 and operative to prevent backflow through the respective inlet 61, 63. According to one embodiment the check valves 67 are made of a silicon material, although other materials known in the art may also be used.

The air inlet passageway 69 is in communication with an air chamber 73 and the oxygen inlet passageway 71 is in communication with an oxygen chamber 75. The air chamber 73 and oxygen chamber 75 are both in communication with a central chamber 77 having an air region 79 and an oxygen region 81. A flexible diaphragm 83 extends across the central chamber 77 and separates the air region 79 from the oxygen region 81. The diaphragm 83 is flexible to reduce the pressure differential between the air and oxygen. Along these lines, the diaphragm 83 is connected to an air valve body 85 and an oxygen valve body 87, which move with the diaphragm 83. The air valve body 85 includes a tapered surface adapted to interface with an air valve seat 89, while the oxygen valve body 87 includes a tapered surface adapted to interface with an oxygen air seat 91. When either one of the tapered surfaces is seated against the corresponding valve seat, fluid is restricted from flowing into the central chamber from the corresponding air or oxygen chambers 73, 75. However, when the tapered surfaces are spaced from the corresponding valve seats, fluid may flow from the corresponding air or oxygen chambers 73, 75 into the central chamber 77. The tapered configuration allows for a variation in the size of the respective passageways extending between the air and oxygen chambers 73 and the central chamber 77 to allow for variation in the amount of air and oxygen flowing into the central chamber 77. In this regard, if the pressure within the air portion 79 is greater than the pressure in the oxygen portion 81, the diaphragm 83 will be biased toward the oxygen chamber 75, which moves the oxygen valve body 87 away from the oxygen valve seat 91, thus, allowing more oxygen to flow into the central chamber 77. Furthermore, such movement also causes the air valve body 85 to move toward the air valve seat 89, thereby reducing the amount of air that flows into the central chamber 77. Therefore, with more oxygen flowing into the central chamber 77 and less air flowing into the central chamber 77, the pressure differential will be reduced.

Conversely, if the pressure within the oxygen portion 81 is greater than the pressure in the air portion 79, the diaphragm 83 will be biased toward the air chamber 73, which moves the air valve body 85 away from the air valve seat 89, thus, allowing more air to flow into the central chamber 77. Furthermore, such movement also causes the oxygen valve body 87 to move toward the oxygen valve seat 91, thereby reducing the amount of oxygen that flows into the central chamber 77. Therefore, with more air flowing into the central chamber 77 and less oxygen flowing into the central chamber 77, the pressure differential will be reduced.

The fluid in the central chamber 77 exits through a pair of exit passageways; namely, an air exit passageway 93 extending from the air portion 79, and an oxygen exit passageway 95 extending from the oxygen portion 81. The exit passageways 93, 95 extend between the pressure balancing module 55 and the proportioning module 57. The proportioning module 57 includes a central mixing chamber 97, an air inlet chamber 99, and an oxygen inlet chamber 101. The air inlet chamber 99 receives air from the air exit passageway 93 and the oxygen inlet chamber 101 receives oxygen from the oxygen exit passageway 97. Both the air inlet chamber 99 and the oxygen inlet chamber 101 are in communication with the central mixing chamber 97. Conduit 58 extends from the central mixing chamber 97 and functions as an exit passageway therefrom. The proportioning module 57 further includes a valve body 103 extending through the oxygen inlet chamber 101, central mixing chamber 97 and the air inlet chamber 99. The valve body 103 includes a several tapered regions specifically configured and adapted to enable control over the amount of fluid flow into the central mixing chamber 97 from a respective one of the air inlet chamber 99 and the oxygen inlet chamber 101. In particular, a first tapered region 105 and a second tapered region 107 are located on opposed sides of a first narrow segment 109. The second tapered regions 107 is configured such that the diameter thereof increases as the second tapered region 107 extends away from the first narrow segment 109 so as to enable control over the size of the opening defined by valve seat 119. The first tapered region 105 may also have a variable diameter to induce desirable flow characteristics over the valve body 103. Similarly, a third tapered region 111 and a fourth tapered region 113 are located on opposed sides of a second narrow segment 115. The third and fourth tapered regions 111, 113 are configured such that the diameter of the tapered regions increase as each tapered region 111, 113 extends away from the second narrow segment 115.

The valve body 103 is configured to translate along axis 116 relative to a proportioning housing 117 to control the amount of air and oxygen leaving the proportioning module 57 through the outlet conduit 58. From the perspective shown in FIG. 6, as the valve body 103 moves to the left, the tapered surface 107 is brought closer to valve seat 119 to reduce the size of the gap between the air inlet chamber 99 and the central mixing chamber 97. Such leftward movement also results in second narrow segment 115 being brought into alignment with valve seat 121 to increase the size of the gap between the oxygen inlet chamber 101 and central mixing chamber 97. Accordingly, the result of the leftward movement is that more oxygen is allowed to flow into the central mixing chamber 97 and less air is allowed to flow into the central mixing chamber 97.

Conversely, as the valve body 103 moves to the right, the first narrow segment 109 is brought into alignment with valve seat 119 to increase the size of the gap between the air inlet chamber 99 and the central mixing chamber 97. Furthermore, the tapered surface 11 is moved toward valve seat 121 to decrease the size of the gap between the oxygen inlet chamber 101 and the central mixing chamber 97. Accordingly, the result of the rightward movement is that more air is allowed to flow into the central mixing chamber 97, while less oxygen is allowed to move into the central mixing chamber 97.

According to one embodiment, the valve body 103 is coupled on one end to a dial 123 and on another end to a spring 125. The spring 125 biases the valve body 103 toward the dial 123. The dial 123 is engaged to with the proportioning housing 117 via a threaded engagement, such that rotation of the dial 123 in a first rotational direction results in the valve body 103 moving in a first axial direction, and rotation of the dial 123 in a second rotational direction results in the valve body 103 moving in a second axial direction.

As noted above, certain embodiments of the hi-flow mixer 54 include an alarm module 59 to provide a signal when the pressure of the air and/or the oxygen falls below a prescribed threshold. In the exemplary embodiment the signal is an audible signal, although it is understood that the signal may also be visual.

The alarm module 59 includes an alarm housing 127 to which is coupled an air inlet 129 and an oxygen inlet 131. The air inlet 129 receives air from air inlet 61, and the oxygen inlet 131 receives oxygen from the oxygen inlet 63. Inside of the alarm housing 127 are two valve chambers 133, 135, each being segregated into three regions. In particular, valve chamber 133 is segregated into first end region 137, second end region 139 and intermediate region 141. Similarly, valve chamber 135 is segregated into first end region 143, second end region 145, and intermediate region 147. The separation of the various regions is achieved via o-rings or other sealing elements coupled to respective valve bodies 149, 151 located within the valve chambers 133, 135. The first end region 135 of valve chamber 133 is in fluid communication with the second end region 145 of valve chamber 135 via passageway 153. Likewise, first end region 143 of valve chamber 135 is in fluid communication with the second end region 139 of valve chamber 133 via passageway 155.

When the air inlet 129 is supplied with pressurized air, the first end region 137 of valve chamber 133 and the second end region 145 of valve chamber 135 are both pressurized with air. Similarly, when the oxygen inlet 131 is supplied with pressurized oxygen, the first end region 143 of valve chamber 135 and second end region 139 of valve chamber 133 are both pressurized with oxygen. The opposing pressures on opposite sides of the valve bodies 149, 151 stabilizes the valve bodies 149, 151, and thus, the valve bodies 149, 151 remain in the positions shown in FIG. 6. Importantly, the oxygen and air remain fluidly isolated from an alarm passageway 157 coupled to alarm reed 159.

However, should pressure loss of the air or oxygen occur, fluid would pass over the alarm reed 159, providing an audible alert to a user indicating a loss of pressure. Should a loss of air pressure occur, a pressure imbalance would be created which would result in valve body 151 moving. In particular, the pressure in second end chamber 145 would be smaller than the pressure in first end chamber 143, and thus, the valve body 151 would move upwardly from the perspective shown in FIG. 6, thereby brining the first end chamber 143 into fluid communication with alarm passageway 157. Accordingly, pressurized oxygen would flow over the alarm reed 159 to create the audible alert signal. Furthermore, pressurized oxygen would flow through the intermediate chamber 141 and open spring biased valve 161, thereby allowing oxygen to flow through alarm outlet 163, which is connected to outlet conduit 58.

Should a loss of oxygen pressure occur, a pressure imbalance would be created which would result in valve body 149 moving. In particular, the pressure in second end chamber 139 would be smaller than the pressure in first end chamber 137, and thus, the valve body 149 would move upwardly from the perspective shown in FIG. 6, thereby brining the first end chamber 137 into fluid communication with alarm passageway 157. Accordingly, pressurized air would flow over the alarm reed 159 to create the audible alert signal. Furthermore, movement of valve body 149 would place the pressurized air in communication with spring biased valve 161, which would cause spring biased valve 161 to open and allow air to flow through alarm outlet 163, which is connected to outlet conduit 58.

Referring now back to FIG. 2, the fluid exits the hi-flow mixer 54 through conduit 58, which connects with chamber inlet conduit 60. The chamber inlet conduit 60 delivers pressurized fluid to the chamber housing 10. A relief valve 62 is connected to the chamber inlet conduit 60 via conduit 64 and is configured to direct fluid to an exhaust via conduit 66 when the pressure in the inlet conduit 60 exceeds a prescribed pressure. In the exemplary embodiment, the relief valve 62 is opened when pressure in the inlet conduit 60 exceeds 35 psi, although the pressure at which relief valve 62 may open may vary, and thus, may be below 35 psi or above 35 psi without departing from the spirit and scope of the present disclosure.

The mixture of oxygen and air is delivered into the chamber housing 10 through the chamber inlet conduit 60 for ventilation therapy to the animal. The mixture then exits the chamber housing 10 through exit conduit 68, passes through exhaust pressure regulator 70 and then passes through ventilation control 72 before exiting the system via an exhaust. The exhaust pressure regulator 70 regulates the pressure of the fluid exhausted from the chamber housing 10 for controlling fluid flow and pressure within the chamber housing 10. However, since fluid pressure within the chamber 10 is relatively low during ventilation therapy, the exhaust pressure regulator 70 typically has little impact on the fluid flow during FREE FLOW mode. The ventilation control 72 allows for control over the flow rate of fluid exiting the system. For instance, the ventilation control 72 may ensure that the fluid exiting the system is flowing at a predetermined flow rate, which according to one embodiment, may range anywhere from 80 liters/min-400 liters/min.

The system may be transitioned from the FREE FLOW mode to the HYPERBARIC mode by transitioning the master valve 22 from the FREE FLOW position to the HYPERBARIC position. Such a transition causes the pressurized control fluid to be directed by the master valve 22 into the conduit 42. Accordingly, the free flow control conduit is no longer pressurized when the master valve 22 is in the HYPERBARIC mode, which causes the mixer air on/off valve 32 and the mixer oxygen on/off valve 34 to close. In this respect, no air is received from the air inlet, although oxygen is received into the system through oxygen on/off valve 46, as will be described in more detail below. Accordingly, the overall fluid system shown in FIG. 2 may be considered to include a first mode fluid network that communicates oxygen from the oxygen inlet to the veterinary therapy chamber when the fluid system is in the HYPERBARIC mode (i.e. a first mode of operation), and a second mode fluid network that communicates a mixture of oxygen and air to the therapy chamber when the fluid system is in the FREE FLOW mode (i.e., a second mode of operation).

In the HYPERBARIC mode, the pressure in conduit 42 passes through normally open 3-way valve 44, and into conduit 48 and applies pressure to oxygen on/off valve 46, which causes the oxygen on/off valve 46 to open. Accordingly, pressurized oxygen passes through the oxygen on/off valve 46, and through compression regulator 74. A pneumatic control system 76 is in communication with the fluid passing through the oxygen on/off valve 46, and provides an input signal to the compression regulator 74. Fluid exiting the compression regulator 74 may exit via conduit 78, which transitions into chamber inlet conduit 60. As described above, chamber inlet conduit 60 delivers fluid into the chamber housing 10 for treating the animal.

In the case of the HYPERBARIC mode, the fluid is delivered into the chamber housing 10 for hyperbaric therapy, wherein pressure within the chamber is elevated above ambient pressure. The fluid exits the chamber housing 10 through exit conduit 68 and passes through exhaust pressure regulator 70, which enables control over the fluid flow and fluid pressure within the chamber housing 10 when operating in the HYPERBARIC mode. The fluid then flows through ventilation control 72 and then exits through the exhaust.

It understood that when the system is operating in the HYPERBARIC mode, an emergency condition may arise, such as an urgent health condition of the animal, which may require prompt venting of the fluid within the chamber housing 10. Accordingly, the system may be transitioned to the EMERGENCY mode, which causes the master valve 22 to place the control pressure from conduit 28 in communication with emergency control conduit 50. Thus, when in the EMERGENCY mode, the conduits associated with the HYPERBARIC mode are disconnected from the control pressure. The emergency control conduit 50 extends from the master valve 22 to an emergency vent button 80 having an actuator 82. A conduit 84 extends from the emergency vent button 80. When the master valve 22 is in the EMERGENCY mode, and the emergency vent button 80 is actuated/depressed, the emergency vent button 80 is configured to place the emergency control conduit 50 in communication with the conduit 84. In this regard, the emergency control conduit 50 is only placed in communication with the conduit 84 only when two conditions are met 1) the master valve 22 is placed in the EMERGENCY position, and 2) the actuator 82 on the emergency vent button 80 is actuated. Placing the emergency control conduit 50 in communication with the conduit 84 pressurizes the conduit 84, which in turn, causes emergency vent valve 86 to open, which allows for venting of the fluid from the chamber housing 10.

The system may also include an alternative means for venting the chamber housing 10 in emergency conditions. Along these lines, the system may include an emergency shutdown switch 88 which may be actuated to vent the chamber housing 10. In this regard, the emergency shutdown switch requires a single action (i.e., actuating the switch), which is contrasted with the venting procedure discussed above, which requires two actions, namely, movement of the master valve 22 to the EMERGENCY VENT position as well as actuation of the actuator 82 on the emergency vent button 80. Although the present disclosure uses the term "switch," it is understood that the emergency shutdown switch 88 may be actuated with a button, lever, or other actuator known in the art.

The emergency shutdown switch 88 includes conduits 90, 92 connected thereto. Conduit 90 extends from conduit 26 and is pressurized from the pressurized oxygen in conduit 26. When the emergency shutdown switch 88 is in a first position, the conduit 92 is fluidly disconnected from conduit 90. However, when the emergency shutdown switch 88 is in a second position, the conduit 92 is fluidly connected to conduit 90 through the emergency shutdown switch 88. Conduit 92 extends from the emergency shutdown switch 88 to the 3-way valve 44. Accordingly, when conduit 92 becomes pressurized in response to being fluidly connected to conduit 90, the pressure in conduit 92 causes the 3-way valve 44 to close, which in turn, closes the oxygen on/off valve 46 and shuts off the supply of oxygen to the chamber housing 10. Conduit 94 extends from conduit 92 to a normally-closed 2-way valve 96, which extends between the conduit 94 and conduit 26. When the conduit 94 is pressurized in response to the emergency shutdown switch 88 being actuated, the normally-closed 2-way valve 96 is opened, which pressurizes conduit 98 extending from 2-way valve 96. Conduit 98 is fluidly coupled to conduit 84, which extends to emergency vent valve 86, such that pressurization of conduit 98 causes the emergency vent valve 86 to open, and the fluid within the chamber housing 10 is able to be vented therefrom.

In use, a patient/animal can be placed within the interior of the chamber housing 10 via use of the gurney 20. The front door 12 of the chamber 10 can be closed and the control system 16 can be initiated to deliver either conventional hyperbaric chamber operation or supplemental oxygen therapy at ambient conditions within the interior of the chamber 10.

In the supplemental oxygen therapy mode of operation, the chamber housing 10 utilizes the FREE FLOW mode which allows delivery of approximately 80 liters per minute continuous flow of 0.21 through 1.0 FI02 adjustable oxygen gas mixture. The oxygen gas mixture is delivered at ambient pressure entering from ports in the front entry door 12 flowing across the animal within the interior of the chamber housing 10 and exiting at the opposite end of the chamber housing 10 through a port 30 formed in the rear panel 14 of the chamber 10. The high flow gas mixture of the present disclosure is used to maintain accurate gas mixture concentration with fluctuating supply pressures of 50-70 psi medical air and/or medical oxygen gas supplies. The high flow gas mixture also incorporates an alarm/bypass module which monitors gas supply pressures and with the alarm and actuated bypass to the remaining gas supply in the event of a supply gas failure. The present disclosure allows the delivery of an adjustable enriched oxygen gas mixture without the need for troublesome masks, hoods, cannulas, or cages.

Although the foregoing description uses the term "conduit" to refer to the interconnection between two pneumatic components, those skilled in the art will understand that the term "conduit" may refer to a hose, pipe, pneumatic line, or other fluid interconnection known in the art.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A multi-mode, veterinary therapy chamber device comprising:

a housing including a therapy chamber;

an oxygen inlet connectable to a source of pressurized oxygen;

an air inlet connectable to a source of pressurized air;

a master control valve connectable to the oxygen inlet to receive pressurized oxygen therefrom, the master control valve being transitional between at least a first position and a second position; and a fluid delivery network connected to the master control valve and the therapy chamber, the fluid delivery network having a first passageway and a second passageway both of which extend from the master control valve so as to receive fluid from the master control valve;

when the master control valve is in the first position, the first passageway is in fluid communication with the oxygen inlet and is fluidly isolated from the air inlet, and the second passageway is fluidly isolated from both the oxygen inlet and air inlet to facilitate delivery of oxygen to the therapy chamber along the first passageway;

when the master control valve is in the second position, the first passageway is fluidly isolated from both the oxygen inlet and the air inlet, and the second passageway is in fluid communication with the oxygen inlet and the air inlet to facilitate a mixture of oxygen and air to the therapy chamber alone the second passageway.

2. The device recited in claim 1, wherein the fluid delivery network includes a mixer fluidly connectable to the oxygen inlet and the air inlet when the fluid delivery network is in the second operational mode, the mixer being operative to facilitate varying a ratio of oxygen-to-air in the mixture delivered to the therapy chamber.

3. The device recited in claim 2, wherein the mixer includes:

a mixer air inlet;

a mixer oxygen inlet;

a pressure balancing chamber in communication with the mixer air inlet and the mixer oxygen inlet;

a diaphragm extending through the pressure balancing chamber;

an air valve body coupled to the diaphragm, the air valve body being sized and positioned to control fluid flow from the mixer air inlet to the pressure balancing chamber; and an oxygen valve body coupled to the diaphragm, the oxygen valve body being sized and positioned to control fluid flow from the mixer oxygen inlet to the pressure balancing chamber.

4. The device recited in claim 3, wherein the mixer further includes:

a mixing chamber in communication with the pressure balancing chamber; and a valve body moveable relative to the mixing chamber, the valve body being sized and structured to vary the ratio of oxygen-to-air in the mixture exiting the mixing chamber for delivery to the therapy chamber.

5. The device recited in claim 4, wherein the mixer includes a mixer housing and the valve body includes at least one tapered surface which interfaces with the mixer housing for varying the ratio of oxygen-to-air in the mixture exiting the mixing chamber for delivery to the therapy chamber.

6. The device recited in claim 3, wherein the mixer further includes an alarm in fluid communication with the mixer air inlet and the mixer oxygen inlet, the alarm generating an alarm signal in response to fluid pressure at one of the mixer air inlet and the mixer oxygen inlet falling below a prescribed threshold.

7. The device recited in claim 2, wherein the fluid delivery network includes:

a first oxygen valve in fluid communication with the oxygen inlet;

a second oxygen valve in fluid communication with the oxygen inlet and the mixer; and an air valve in fluid communication with the air inlet and the mixer;

in the first operational mode, the first oxygen valve being open to allow pressurized oxygen to flow therethrough, and the second oxygen valve and air valve both being closed to prevent fluid flow therethrough;

in the second operational mode, the first oxygen valve being closed to prevent fluid flow therethrough, and the second oxygen valve and air valve both being open to allow pressurized oxygen and pressurized air to flow through the second oxygen valve and the air valve, respectively.

8. The device recited in claim 7, wherein the first oxygen valve, second oxygen valve, and air valve are normally closed, and are capable of being transitioned to respective open positions in response to a pressurized control fluid being applied thereto.

9. The device recited in claim 1, further comprising a fluid control passageway extending between the master control valve and at least one of the oxygen inlet and the air inlet.

10. The device recited in claim 1, wherein the fluid delivery network includes an alarm operative to generate an alarm signal in response to a fluid pressure within the fluid delivery network falling below a prescribed threshold.

11. The device recited in claim 1, further comprising a relief valve in communication with the fluid delivery network, the relief valve being operative to exhaust fluid from the fluid delivery network in response to a fluid pressure in the fluid delivery network exceeding a prescribed threshold.

12. The device recited in claim 11, wherein the prescribed threshold is 35 PSI.

13. The device recited in claim 1, further comprising a vent valve downstream of the therapy chamber, the vent valve being normally closed and operative to open to vent fluid from the therapy chamber.

14. A multi-mode, veterinary therapy chamber device comprising:

a housing including a therapy chamber;

an oxygen inlet connectable to a source of pressurized oxygen;

an air inlet connectable to a source of pressurized air;

a control conduit in communication with the oxygen inlet to receive pressurized oxygen therefrom;

a master control valve in communication with the control conduit to receive pressurized oxygen therefrom, the master control valve being transitional between at least a first position and a second position;

a first passageway and a second passageway both fluidly connected to the master control valve and the therapy chamber;

when the master control valve is in the first position, the master control valve directs pressurized oxygen from the control conduit to the first passageway and the first passageway is fluidly isolated from the air inlet to facilitate delivery of oxygen to the therapy chamber along the first passageway, and the second passageway is fluidly isolated from both the oxygen inlet and air inlet;

when the master control valve is in the second position, the master control valve directs pressurized oxygen from the control conduit to the second passageway, and the second passageway receives pressurized air from the air inlet to facilitate delivery of a mixture of pressurized oxygen and air to the therapy chamber, and the first passageway is fluidly isolated from both the oxygen inlet and the air inlet.

15. The device recited in claim 14, further comprising a normally closed oxygen valve that is pneumatically actuated from a closed position to an open position in response to the master control valve assuming its second position.

16. The device recited in claim 15, further comprising a normally closed air valve that is pneumatically actuated from a closed position to an open position in response to the master control valve assuming its second position.

17. The device recited in claim 16, further comprising a mixer disposable in communication with the air inlet and the oxygen inlet and downstream of both the oxygen valve and the air valve to receive pressurized air and pressurized oxygen from the air inlet and the oxygen inlet when the master control valve assumes its second position.

18. The device recited in claim 17, wherein the mixer includes:

a mixer air inlet;

a mixer oxygen inlet;

a pressure balancing chamber in communication with the mixer air inlet and the mixer oxygen inlet;

a diaphragm extending through the pressure balancing chamber;

an air valve body coupled to the diaphragm, the air valve body being sized and positioned to control fluid flow from the mixer air inlet to the pressure balancing chamber; and an oxygen valve body coupled to the diaphragm, the oxygen valve body being sized and positioned to control fluid flow from the mixer oxygen inlet to the pressure balancing chamber.

19. The device recited in claim 18, wherein the mixer further includes:

a mixing chamber in communication with the pressure balancing chamber; and a valve body moveable relative to the mixing chamber, the valve body being sized and structured to vary the ratio of oxygen-to-air in the mixture exiting the mixing chamber for delivery to the therapy chamber.

20. The device recited in claim 19, wherein the mixer includes a mixer housing and the valve body includes at least one tapered surface which interfaces with the mixer housing for varying the ratio of oxygen-to-air in the mixture exiting the mixing chamber for delivery to the therapy chamber.

* * * * *